US006378777B1

(12) United States Patent
Valcic et al.

(10) Patent No.: US 6,378,777 B1
(45) Date of Patent: Apr. 30, 2002

(54) NATURAL DRAFT WATER HEATER

(75) Inventors: Zoran Valcic, Chatswood; Geoffrey Mervyn Whitford, Dundas, both of (AU)

(73) Assignee: Southcorp Australia Pty Ltd. (AU)

( * ) Notice: Subject to any disclaimer, the term of this patent is extended or adjusted under 35 U.S.C. 154(b) by 0 days.

(21) Appl. No.: 09/561,368

(22) Filed: Apr. 28, 2000

Related U.S. Application Data

(63) Continuation-in-part of application No. PCT/AU99/00818, filed on Sep. 24, 1999.

(30) Foreign Application Priority Data

Sep. 24, 1998 (AU) ..... PP6161

(51) Int. Cl.[7] ..... F24D 3/00
(52) U.S. Cl. ..... 237/8 R; 165/158; 122/18.1
(58) Field of Search ..... 237/19, 55; 165/158, 165/157, 169; 122/31.1, 32, 18.1, 18.3

(56) References Cited

U.S. PATENT DOCUMENTS 4,397,296 A * 8/1983 Moore, Jr. et al. ..... 126/360
4,678,116 A * 7/1987 Krishnakumar et al. .. 236/25 A
4,779,795 A * 10/1988 Winmill ..... 237/51
4,823,770 A * 4/1989 Loeffler ..... 126/362
4,981,122 A * 1/1991 Adams et al. ..... 122/19
5,022,379 A * 6/1991 Wilson, Jr. ..... 126/116 R
5,666,944 A * 9/1997 Ferguson ..... 126/391

* cited by examiner

*Primary Examiner*—Harold Joyce
*Assistant Examiner*—Derek S. Boles
(74) *Attorney, Agent, or Firm*—Schnader Harrison Segal & Lewis LLP

(57) ABSTRACT

The invention relates to a water heater comprised of a cylindrical tank 18 which has a central flue 20 that is mounted with the cylinder axis 40 vertical. The water heater further includes a gas burner 22 provided the base of the tank 18, which burns a gaseous fuel so as to discharge heated gases up through the central flue 20 from the base to the top of the tank 18.

A housing 12 surrounds the exterior of the tank and is spaced away from the domed top 34 and side walls of the tank 18, to thereby define a generally annular cylindrical space 36 between the radially outer surface of the tank 18 and the radially inner surface of the housing 12. The annular space 36 is in gas flow communication with the upper end of the flue 20 and is provided with a discharge outlet 48 located at or adjacent the lower most end of the tank 18.

In use heated gases pass up the central flue 20, over the top 34 of the tank 18, and down the annular space 36 to thereby heat both the radially inner and the radially outer surfaces of the tank 18 prior to exhausting from the heater.

26 Claims, 6 Drawing Sheets

NATURAL DRAFT WATER HEATER

RELATED APPLICATION

This is a continuation-in-part of International Application No. PCT/AU99/00818, with an international filing date of Sep. 24, 1999, which is based on Australian Patent Application No. PP6161, filed Sep. 24, 1998.

FIELD OF THE INVENTION

This invention relates to a natural draft water heater of the type which has a burner at the base of water tank and a central flue which passes up the centre of the water tank for heating water in the tank.

BACKGROUND OF THE INVENTION

Water heaters of the aforementioned type are well-known and are used extensively for domestic water heating and other applications. The efficiency of such water heaters is considered to be an important consideration by many owners or operators of water heaters.

Generally, the flue leading through the centre of the water tank exits through an exhaust located near the top of the tank. It is important for proper operation of a water heater that the flow of exhaust gases through the tank is not impeded to the extent where the exhaust passage becomes blocked or choked thereby hindering the efficient operation of the tank. For this reason, most tanks have a straight through flow exhaust arrangement.

One problem of the aforementioned type of exhaust arrangement is that the exhaust gases leading through an exhaust outlet from the tank are generally reasonably hot. The heat in the exhaust gases is thus lost to atmosphere with the result that the water heater is not as efficient as it would be if more of the heat were to be extracted from the exhaust gas prior to it exhausting.

A further problem with many water heaters arises as a consequence of the cylindrical shape of a typical water heater. When such a water heater is mounted against a wall, narrow wedge shaped recesses are formed at the back of the water heater which are difficult to clean and can accumulate dirt or provide a haven for rodents or other animals. This could ultimately adversely affect the operation of the heater or provide a potential hazard during operation of the heater.

SUMMARY OF THE INVENTION

According to a first aspect of the invention there is provided a water heater comprising:

- a generally cylindrical tank which has a central flue which is adapted to be mounted with the cylinder axis generally vertical,
- a burner located towards the base of the tank adapted to burn a fuel to discharge heated gases up through the central flue,
- a cylindrical flow directing casing surrounding the tank and spaced away from the top and sides of the tank to define a generally annular cylindrical space between the radially outer surface of the tank and the radially inner surface of the casing, said space being in gas flow communication with the upper end of the flue, said annular space having a discharge outlet located at or adjacent the lower most end of the tank,
- the arrangement being such that, in use, heated gases pass up the central flue, over the top of the tank, and down the annular space to thereby heat both the radially inner and the radially outer surfaces of the tank prior to exhausting from the heater.

Further there is provided for the casing to be surrounded by a coaxial exhaust cylinder and for the exhaust cylinder to be spaced away from the casing, at least in the lower region of the casing, to thereby define an annular exhaust passage into which the discharge outlet discharges exhaust gases passing from the annular space in use.

Further there is provided an exhaust outlet from said exhaust passage, said exhaust outlet being located at an elevation which is higher than said discharge outlet.

Optionally at least part of the exhaust cylinder is insulated, and preferably at least the major part of the exhaust cylinder is insulated.

The burner is preferably adapted to burn fuel at a sufficiently high temperatures to ensure that the heated gases move up the flue, down the annular space, and up the exhaust passage without clogging, choking or blocking the flow of exhaust gases through the heater.

It is preferred that the exhaust outlet is located at an elevation which is between 20% and 40% of the height of the tank from the base of the tank.

Optionally, the casing may have a flow directing cone shaped protrusion which is positioned on the longitudinal axis of the cylinder and projects downwardly, said protrusion being arranged to guide the flow of gases passing up the flue in a radially outwardly direction, towards the annular space.

According to a second aspect of the invention there is provided a water heater comprising:

- a generally cylindrical water tank which is adapted to be mounted with the cylinder axis generally vertical;
- a burner located towards the base of the tank adapted to burn fuel to heat water in the tank; and
- a generally cylindrical, non-circular housing surrounding the tank said housing having a rear side and a front side, the rear side being of generally planar configuration, the front side being of generally circular, U or parabolic shape in cross section.

The housing may have an air inlet and/or an exhaust outlet in said front side diametrically opposite said rear side. The air inlet and/or exhaust outlet may be located at a height of between 20% and 50% of the height of the housing. The front and rear sides are preferably integrally formed with each other, and the housing may be formed of sheet metal or the like. The housing is preferably specifically adapted to be mounted with the rear side substantially flush against a planar wall to which the water heater is mounted. The water tank is preferably of a configuration having a central flue and having an annular flow passage around the outside of the water tank through which exhaust gases pass prior to exhausting from the housing.

The invention extends to a method of heating water in a cylindrical tank, said method including the steps of passing heated gases up a central flue within the tank, allowing those gases to pass over the top of the tank and down the sides of the tank, and directing those gases to an outlet located at or adjacent the base of the tank. The method preferably includes the further step of directing the gases from the outlet to an exhaust passage which extends upwardly from said outlet to an exhaust outlet located at a higher elevation than the base of the tank.

These and further features of the invention will be made more apparent from the description of preferred embodiments of the invention given below by way of examples. In the description reference is made to the accompanying drawings but specific features shown in the drawings should not be construed as limiting on the invention. Also, where the word "comprising" or "comprised" is used in the specification and claims the words, if in doubt, should be interpreted inclusively rather than exclusively.

DETAILED DESCRIPTION OF THE EMBODIMENTS

Figure 1:
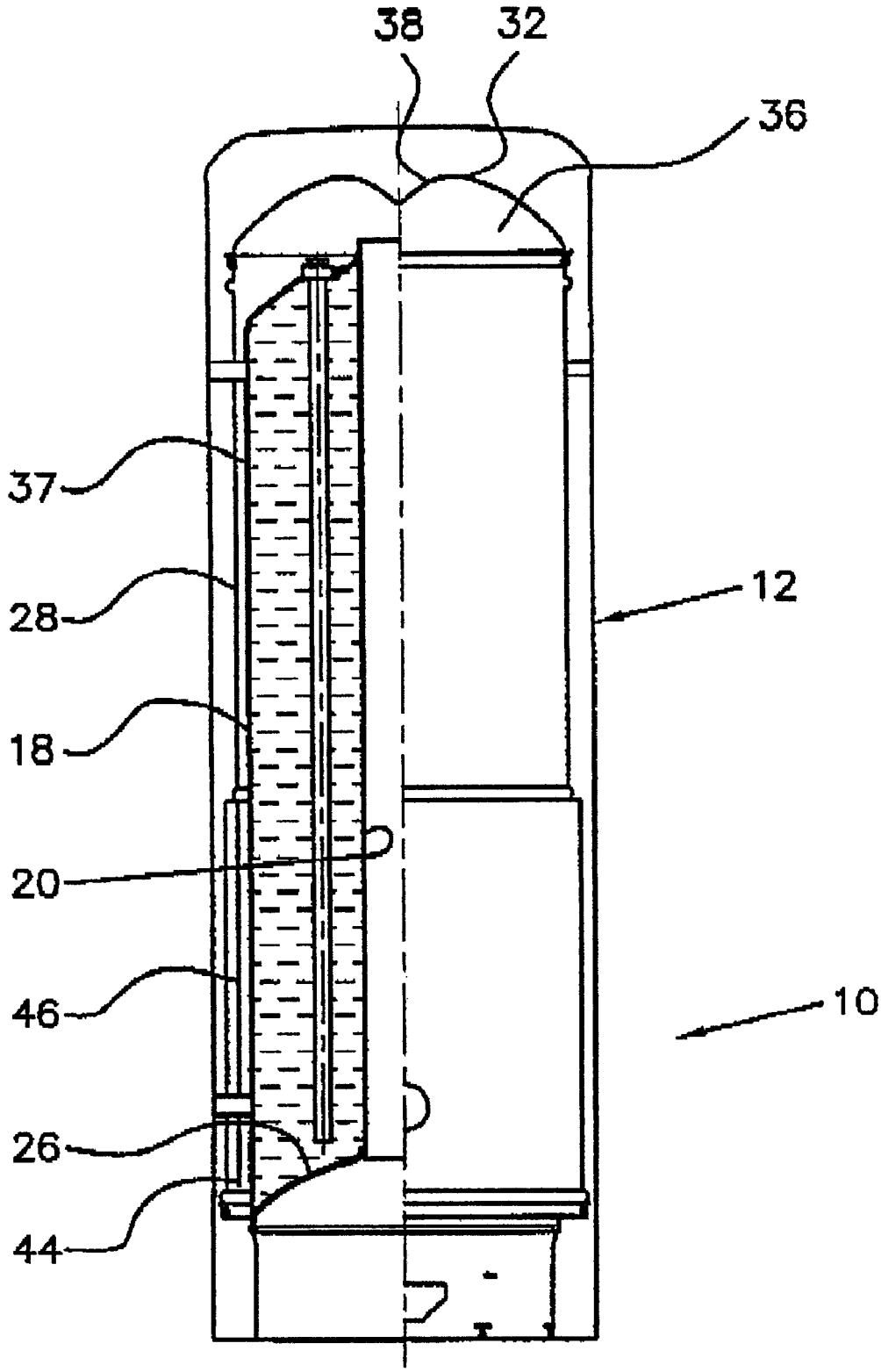
FIG. 1 shows part-sectional side view through a water heater according to the invention.

A water heater 10 shown in the drawings comprises a housing 12 having an inlet 14 and an exhaust outlet 16. Located within the housing 12 is a water tank 18 which is of generally cylindrical configuration having a central flue 20. The tank 18 is adapted to be mounted with the flue 20 extending vertically along the central axis of the tank 18. A burner 22 is located in the base of the housing below the tank and is adapted to burn gas or liquid fuel supplied via a supply pipe 24. The burner 22 directs heated gases into a concave recess 26 formed in the base of the tank 18. A casing 28 surrounds the tank 18, the casing 28 having generally cylindrical side walls 30 and a domed roof 32 which overlies the domed top 34 of the tank 18. The casing side walls 30 are spaced away from the tank 18 so that a heat exchange gap or space 36 is defined between the inner surface of the casing 28 and the outer surface of the tank 18. The lower part 37 of the space 36 is annular in form.

The upper end of the casing 30 has a cone shaped protrusion 38 which is positioned on the longitudinal axis 40 (shown by broken lines in FIG. 2) of the tank and is directed downwardly, that is, towards the flue 20. The protrusion 38 is designed to guide the flow of heated air passing up the flue 20 around and over the top of the tank 18 as indicated by arrows 42.

The casing 30 terminates at a lower end 44 which is positioned approximately adjacent the base of the tank 18, and preferably just above the elevation of the burner 22. It is found in practice that the termination of the casing 30 above the burner 22 facilitates the flow of heated air within the heater and prevents clogging or choking of air flow within the system.

A cylinder 45 surrounds the lower portion of the casing 30 and defines an annular . exhaust passage 46 which surrounds the lower portion of the space 36. Air passing around the lower edge 44 of the casing, as indicated by arrows 48, passes into the exhaust passage 46. The exhaust passage 46 leads the exhaust gases towards the outlet 16. It will be appreciated that with the flow path as described above the heated exhaust gases pass up the central flue 20, around the top of the tank 34, and down the annular space 37, thus being in contact with first the inner surface of the tank and then the outer surface of the tank in passing up and down the length of the tank. In so doing, heat will be extracted from these gases on both the upward passage and thereafter on the downward passage so that by the time the heated gases pass around the lower edge 44 of the casing a significant proportion of the heat in the gases will have been conducted through the wall of the tank to the water located within the tank 18.

A further advantage of the flow passage as described herein is that the gas will generally not exhaust through the exhaust outlet 16 unless the burner 22 is actually operating. In other words, for gas to pass out the flue 20 and down the space 37 the burner will need to be firing. When the burner 22 is switched off the gas will tend to stop flowing fairly rapidly and therefore both the inner surface and the outer surface of the tank 18 will be in contact with relatively stationary but heated gas. The heat in that gas will, in time, pass to the water within the tank 18 and therefore a significant percentage of the heat in that gas will be utilised. This utilisation of the heat in the gas will, it is envisaged, add significantly to the efficiency of the system so that by the time the exhaust gas passes out through the exhaust outlet 16 the gas temperature will be relatively low that is, a significant proportion of the heat in that gas will have passed to the water in the tank.

When the burner 22 is again ignited the heated gas will start flowing up the flue 20 and gas flow through to the system will commence once again. It is found that selecting the elevation of the lower edge 44 of the casing is reasonably important to ensure the clogging or choking of the flow passage does not occur each time the burner is restarted or where the burner switches off and only a pilot light remains alight.

Turning to FIGS. 3 to 6 of the drawings, a second embodiment of heater according to the invention is shown. In this embodiment the heater 50 has a housing 52 which surrounds the tank 18 and is of cylindrical configuration, but as is clear from the drawings, is of non circular shape cross section. As clearly shown in FIG. 5, the housing 52 has a rear side 54 and a front side 56. The rear side 54 is generally flat or planar whereas the front side 56 has a U-shape in cross section having an arcuate or rounded front face 58 and generally flat and parallel side faces 60. In use the rear side 54 of the heater will be placed flush against a wall or other flat surface at which the water heater 50 will be located.

The housing 52 has a rounded lower panel 62 on the front side thereof which shields the inlet 64 and exhaust outlet 66. Also, the lower panel 62 houses controls which are accessible through an access door 68 located in the lower regions thereof.

It will be appreciated that the flat rear side 54 will ensure that when the heater is placed up against a wall it will provide a neat and well finished appearance and will also ensure that no readily accessible gaps are formed at the rear side of the heater in which dirt, animals or the like may accumulate or be accommodated. In addition air moving across the housing 52 at the lower portions thereof may tend to travel past lower panel 62 rather than between the housing 52 and a wall against which it is located.

In addition, the non-circular form of the housing can be used to accommodate pipes, control apparatus, and the like which will be encapsulated within the housing in "dead spaces" within the housing, resulting in an appearance for the water heater which is neat and aesthetically pleasing.

It may be necessary, for different configurations of water tank and casing arrangements, to alter the configurations of the different components of the water heater to ensure that gas clogging does not occur. However, by causing the heated exhaust gases to follow the "sinusoidal" flow path described herein the efficiency of the water heater can be optimised and certainly the water heater will be far more efficient than if the exhaust gases were simply allowed to exhaust out of the water heater from the top of the water tank. To minimise the loss of heat through the housing it is envisaged that the space between the casing and the housing will be insulated with a suitable insulation material indicated at numeral 51 (shown in FIG. 2).

Figure 2:
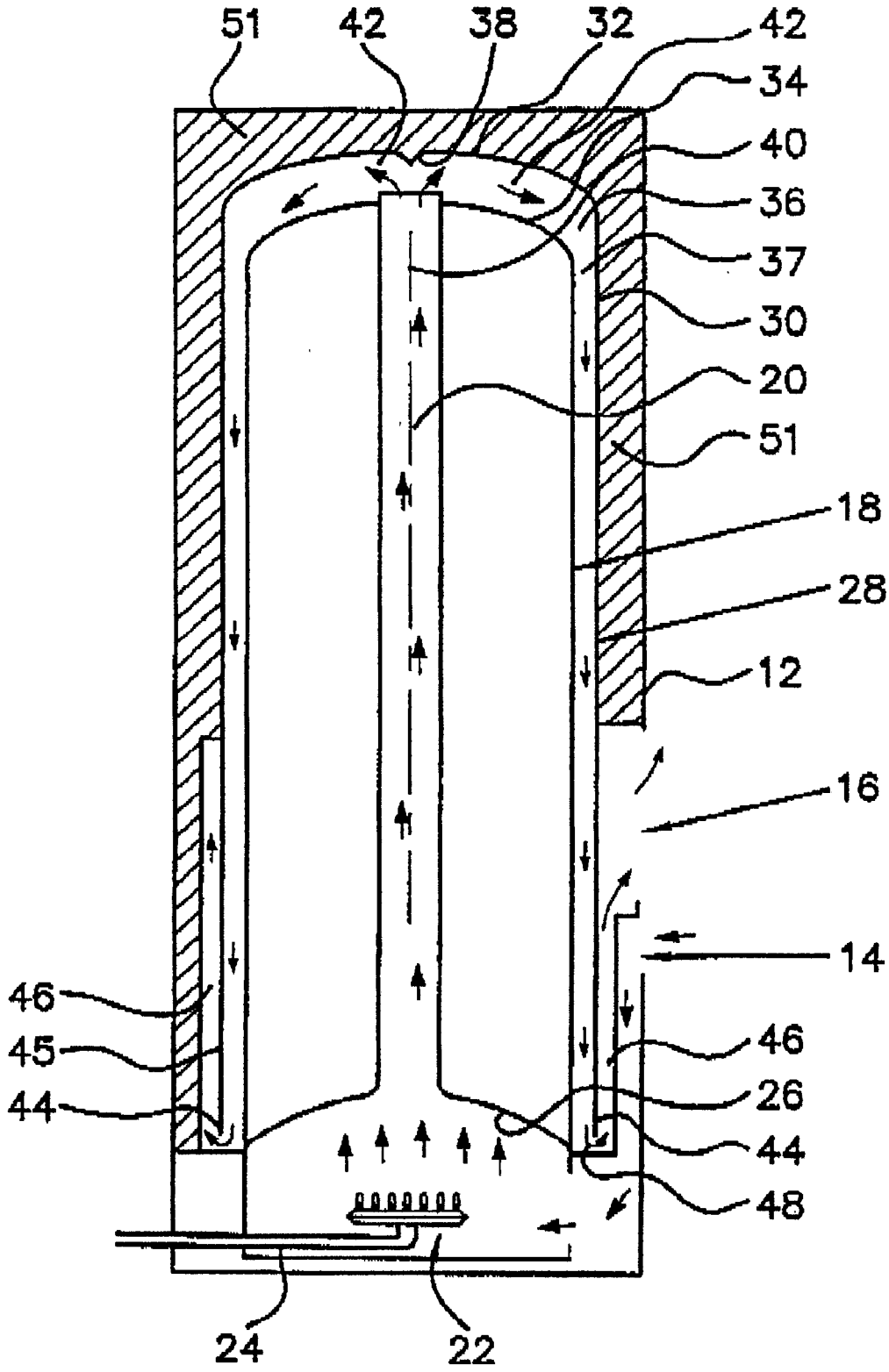
FIG. 2 shows a cross-sectional view of the water heater shown in FIG. 1 depicting the flow of gases within the tank.
Figure 3:
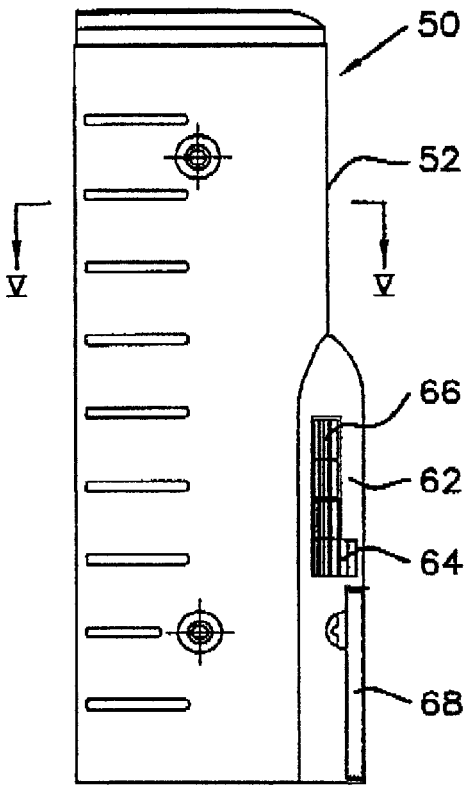
FIG. 3 shows a side view of a second embodiment of water heater according to the invention.
Figure 4:
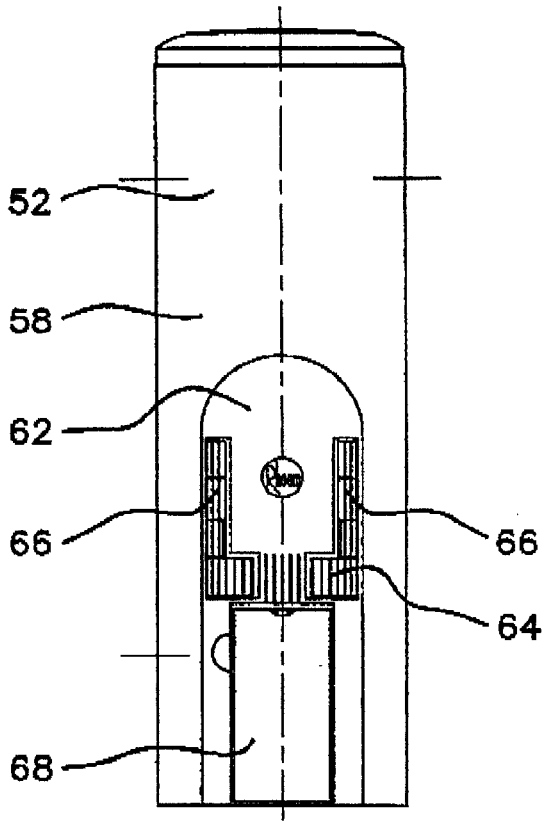
FIG. 4 shows a front view of the heater shown in FIG. 3.
Figure 5:
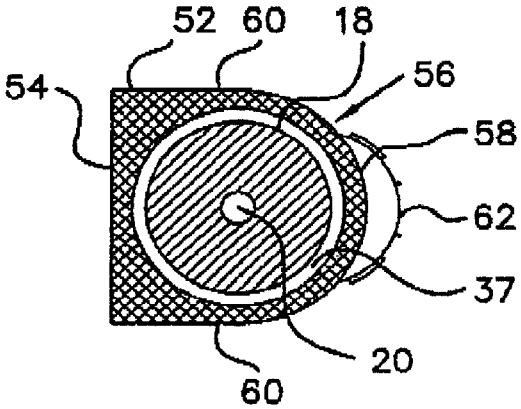
FIG. 5 shows a cross-sectional plan view of the heater shown in FIG. 3 along section line V—V.
Figure 6:
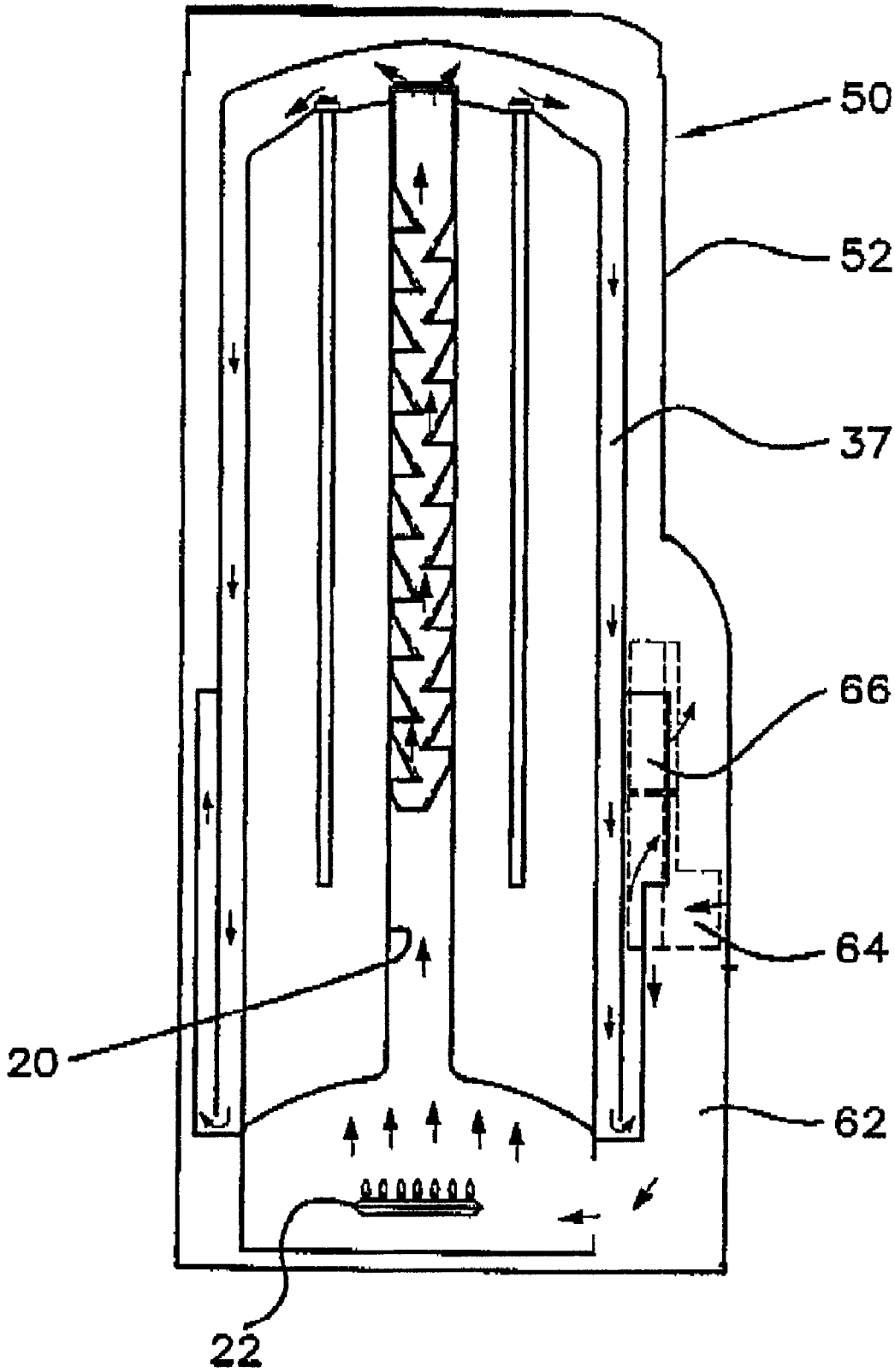
FIG. 6 shows a cross-sectional side view of the heater shown in FIG. 3.
Figure 7:
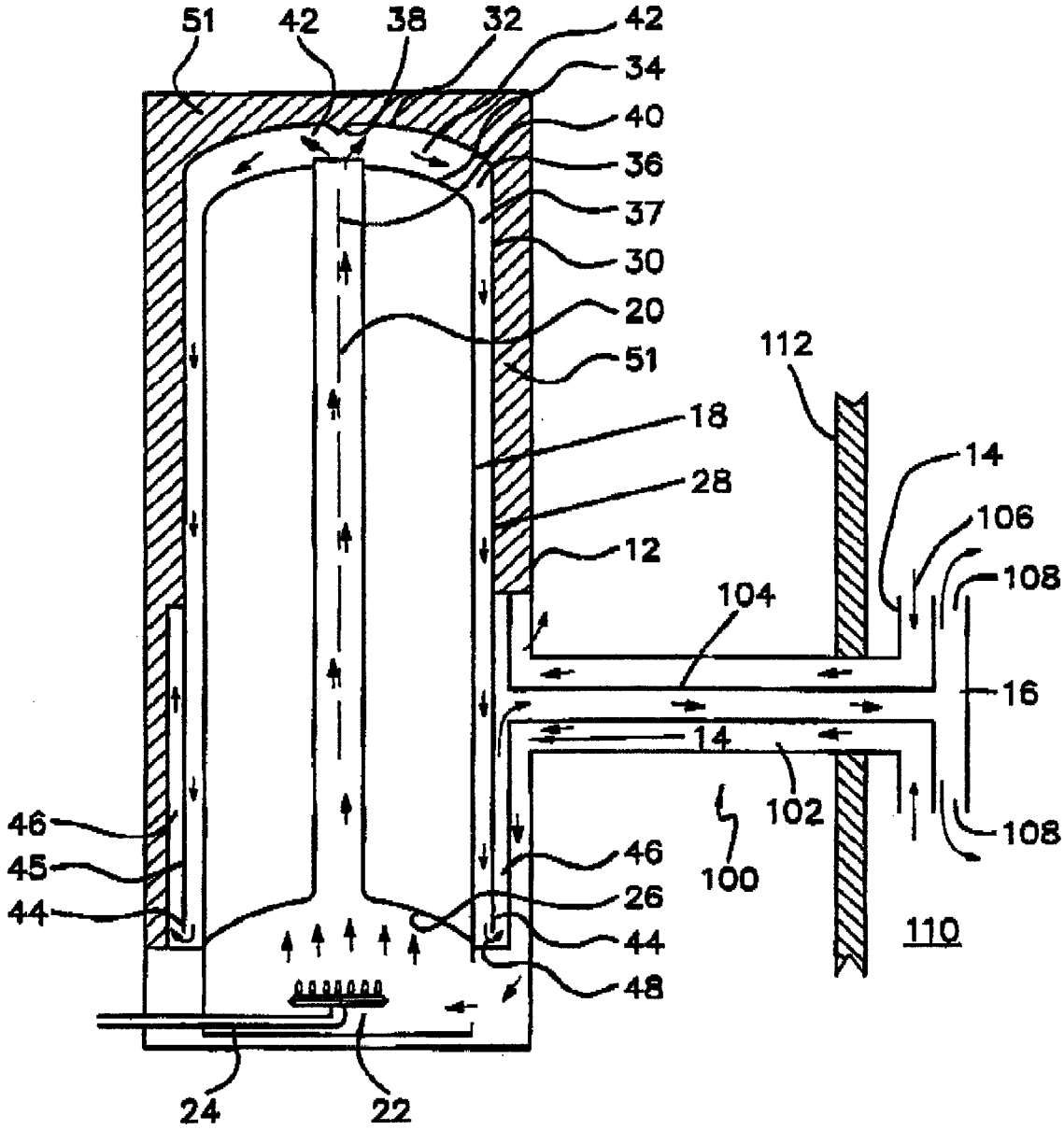
FIG. 7 shows a cross-sectional view of the water heater similar to that shown in FIG. 1 depicting the flow of gases within the tank and with a balanced flue for the entry of air to the combustion chamber and for the exhausting of combustion products.

Illustrated in FIG. 7 is a water heater similar to that illustrated in FIG. 2 and like parts have been like numbered.

The water heater of FIG. 7 differs from that of FIG. 2 in that a balanced flue assembly 100 is provided. The balanced flue assembly 100 is made from two concentrically arranged conduits 102 and 104. The combustion products exiting the water heater from passage 46 pass into the conduit 104 and out through annular outlets 108 which form an exhaust outlet 16. Simultaneously air for the combustion process is drawn into the combustion chamber 22 via the inlet 14 comprising annular inlet 106 and passes to the housing 12 via the annular passage formed between the internal surface of the conduit 102 and the external surface of the concentric conduit 104.

Figure 8:
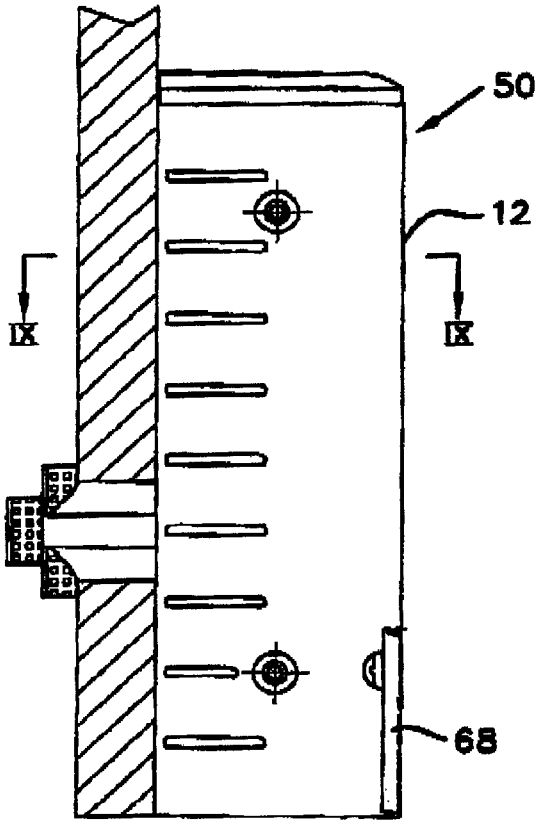
FIG. 8 illustrates a side elevation of a water heater having a cross section similar to that of FIG. 7.
Figure 9:
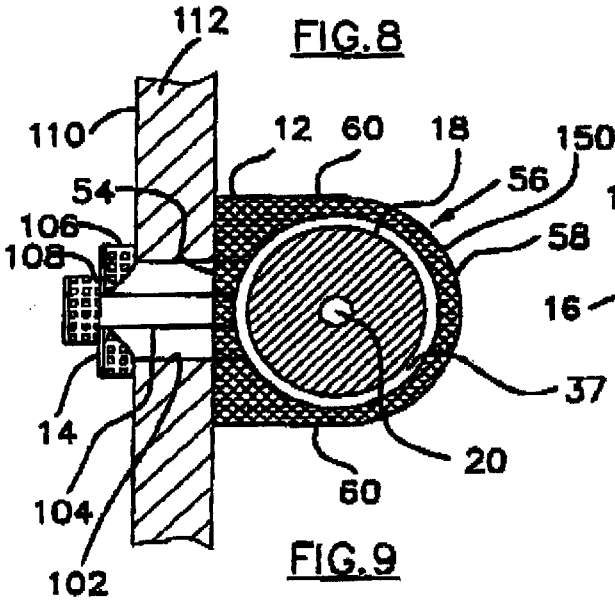
FIG. 9 illustrates a lateral cross section through the water heater of FIG. 8.

The inlet 14 and outlet 16 are adapted to be positioned on the external side 110 of a wall 112, which makes the water heater of FIG. 7 well adapted for use in cold environments where the water heater is likely to be positioned in a basement or garage etc. Illustrated in FIG. 8 and 9 is a water heater 150 which can employ the features of FIG. 7. Like features in common with FIG. 7 and figures land 2 have been like numbered. As can be seen from FIG. 9 the embodiment of FIGS. 8 and 9 has a flat rear face which allows the water heater to be positioned adjacent a wall (preferably an external wall, allowing the balanced flue assembly 100 to take the shortest possible path to the external side 110 of wall 112.

The other peripheries of the water heater 150 as can be seen from FIG. 9 include two straight sides and a semicircular forward end.

Figure 10:
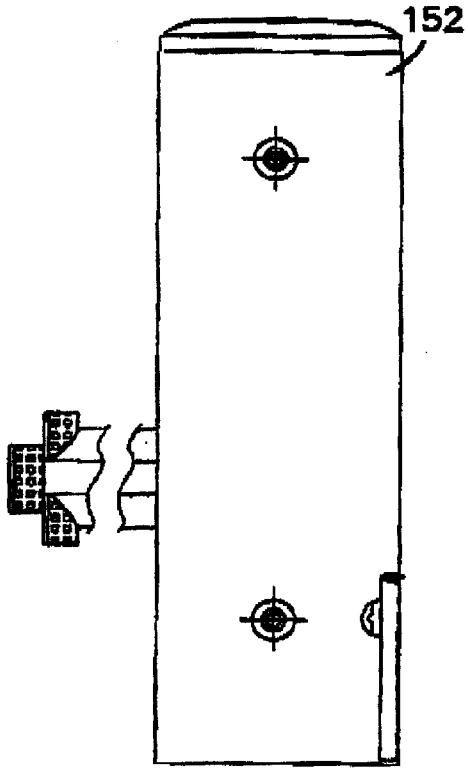
FIG. 10 illustrates a side elevation of a water heater having a cross section similar to that of FIG. 7 but with a different cross sectional shape to that of FIGS. 8 and 9.
Figure 11:
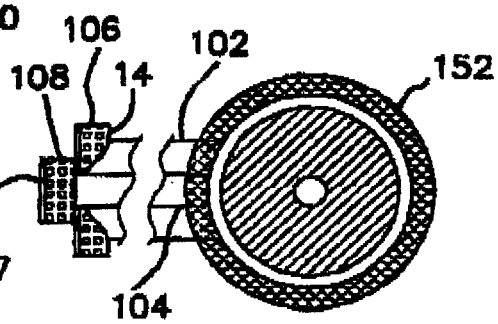
FIG. 11 illustrates a lateral cross section through the water heater of FIG. 10.

Illustrated in FIG. 10 and 11 is another water heater 152 which can employ the features of FIG. 7. Like features in common with FIGS. 1,2, 7, 8 and 9 have been like numbered in FIGS. 10 and 11. The water heater 152 is of a circular external shape when viewed in plan view or in cross section. The balanced flue assembly 100 can be made to pass through a wall (not illustrated) to locate the inlet 14 and outlet 16 on the external side of the wall.

Clearly there may be many variations to the above described embodiment without departing from the scope of the invention. In particular, the configurations of the various components will need to be modified for different burner ratings, tank capacities, and air inlet and exhaust outlet requirements. However, it has been found that for at least certain burner arrangements a satisfactory flow of gas through the system will take place. It will be understood that the invention disclosed and defined herein extends to all alternative combinations of two or more of the individual features mentioned or evident from the text or drawings. All of these different combinations constitute various alternative aspects of the invention.

The foregoing describes embodiments of the present invention and modifications, obvious to those skilled in the art can be made thereto, without departing from the scope of the present invention.

What is claimed is:

1. A water heater comprising:

a generally cylindrical tank which has a central flue which is adapted to be mounted with the cylinder axis generally vertical, a burner located towards the base of the tank adapted to burn a fuel to discharge heated gases up through the central flue, a cylindrical flow directing casing surrounding the tank and spaced away from the top and sides of the tank to define a generally annular cylindrical space between the radially outer surface of the tank and the radially inner surface of the casing, said space being in gas flow communication with the upper end of the flue, said annular space having a discharge outlet located at or adjacent the lower most end of the tank, the arrangement being such that, in use, heated gases pass up the central flue, over the top of the tank and down the annular space to thereby heat both the radially inner and the radially outer surfaces of the tank prior to exhausting from the heater.

2. A water heater as claimed in claim 1, wherein the casing is surrounded by a coaxial exhaust cylinder that is spaced away from the casing and is located at least in the lower region of the casing, to thereby define an annular exhaust passage into which the discharge outlet discharges exhaust gases passing from the annular space in use.

3. A water heater as claimed in claim 2, wherein an exhaust outlet is provided from said exhaust passage, said exhaust outlet being located at an elevation which is higher than said discharge outlet.

4. A water heater as claimed in claim 2, wherein at least part of the exhaust cylinder is insulated.

5. A water heater as claimed in 2, wherein substantially all of the exhaust cylinder is insulated.

6. A water heater as claimed in claim 1, wherein the burner is adapted to burn fuel at a sufficiently high temperature to ensure that heated gases move up the flue, down the annular space without clogging, choking or blocking the flow of exhaust gases through the heater.

7. A water heater as claimed in claim 3, wherein the exhaust outlet is located at an elevation which is between 20% and 40% of the height of the tank from the base of the tank.

8. A water heater as claimed in claim 1, wherein the casing has a flow directing cone shaped protrusion which is positioned on the longitudinal axis of the cylinder and projects downwardly, said protrusion being arranged to guide the flow of gases passing up the flue in a radially outwardly direction, towards the annular space in use.

9. A water heater as claimed in claim 2, wherein the annular exhaust passage communicates with an exhaust conduit to carry combustion product away from said water heater.

10. A water heater as claimed in claim 9 wherein said exhaust conduit is arranged within an intake conduit, said intake conduit providing a passage for air to pass through to said burner.

11. A water heater as claimed in claim 10 wherein said exhaust conduit and said intake conduit are arranged concentrically.

12. A water heater as claimed in claim 10 wherein said exhaust conduit and said intake conduit form a balanced flue assembly.

13. A water heater comprising:

a generally cylindrical water tank which is adapted to be mounted with the cylinder axis generally vertical;

a burner located towards the base of the tank adapted to burn fuel to heat water in the tank; and a generally cylindrical, non-circular housing surrounding the tank, said housing having a rear side and a front side, the rear side being of generally planar configuration, the front side of the housing being of generally semi-circular, U-shaped, parabolic or semi elliptical shape in cross section.

14. A water heater as claimed in claim 13, wherein the housing has an air inlet and/or an exhaust outlet in said front side opposite said rear side.

15. A water heater as claimed in claim 14, wherein the air inlet and/or exhaust outlet is located at a height of between 20% and 50% of the height of the housing from its base.

16. A water heater as claimed in claim 13, wherein the front and rear sides are integrally formed with each other.

17. A water heater as claimed in claim 13, wherein the housing is formed of sheet metal or like material.

18. A water heater as claimed in claim 13, wherein the housing is adapted to be mounted with the rear side substantially flush against a wall to which the water heater is to be mounted.

19. A water heater as claimed in claim 13, wherein the water tank is of a configuration having a central flue.

20. A water heater as claimed in claim 13 wherein an annular flow passage is defined around the outside of the water tank through which exhaust gases pass prior to exhausting from the housing.

21. A water heater as claimed in claim 13, wherein the annular exhaust passage communicates with an exhaust conduit to carry combustion product away from said water heater.

22. A water heater as claimed inn claim 21 wherein said exhaust conduit is arranged within an intake conduit, said intake conduit providing a passage for air to pass through to said burner.

23. A water heater as claimed in claim 22 wherein said exhaust conduit and said intake conduit are arranged concentrically.

24. A water heater as claimed in claim 22 wherein said exhaust conduit and said intake conduit form a balanced flue assembly.

25. A method of heating water in a cylindrical tank having a radially outer surface and a central flue, said method including the steps of:

passing heated gases up the central flue;

allowing the heated gases to pass over the top of the tank and downwardly trough a generally annular cylindrical space between the radially outer surface of the tank and a radially inner surface of a cylindrical flow directing casing surrounding the tank and spaced away from the top and sides of the tank; and directing the heated gases to an outlet located at or adjacent the base of the tank.

26. A method of heating water in a cylindrical tank as claimed in claim 25, wherein the method includes the further step of directing the gases from the outlet to an exhaust passage which extends upwardly from said outlet to an exhaust outlet located at a higher elevation than the base of the tank.

* * * * *